US005990765A

United States Patent [19]

Mansour et al.

[11] Patent Number: 5,990,765

[45] Date of Patent: Nov. 23, 1999

[54] PLANAR DUAL MODE FILTERS AND A METHOD OF CONSTRUCTION THEREOF

[75] Inventors: Raafat R. Mansour, Waterloo; Shen Ye, Cambridge, both of Canada

[73] Assignee: COM DEV LTD., Cambridge, Canada

[21] Appl. No.: 08/974,997

[22] Filed: Nov. 20, 1997

[51] Int. Cl.[6] ..... H01P 1/203

[52] U.S. Cl. ..... 333/204; 333/99 S; 505/210

[58] Field of Search ..... 333/204, 205, 333/219, 99 S; 505/210, 701

[56] References Cited

U.S. PATENT DOCUMENTS

| | | | |
|---|---|---|---|
| 5,021,757 | 6/1991 | Kobayashi et al. | 333/204 X |
| 5,648,747 | 7/1997 | Grothe et al. | 333/204 |
| 5,750,473 | 5/1998 | Shen | 333/99 S |
| 5,786,303 | 7/1998 | Mansour | 333/204 X |

FOREIGN PATENT DOCUMENTS

| | | | |
|---|---|---|---|
| 3-49301 | 3/1991 | Japan | 333/204 |
| 1224863 | 4/1986 | U.S.S.R. | 333/204 |
| 1474763 | 4/1989 | U.S.S.R. | 333/204 |

*Primary Examiner*—Seungsook Ham
*Attorney, Agent, or Firm*—Daryl W. Schnurr

[57] ABSTRACT

A planar dual mode filter has one or more resonators with L-shaped sections that are oriented back to back to one another. The filter can be constructed by adjusting the size of a gap between the back to back sections and adjusting the offset distance between adjacent sections. Further, coupling between adjacent resonators can be controlled by adjusting a distance between the adjacent resonators. The filters can be co-planar, stripline, suspended microstripline or microstripline. The filters have a film on a substrate with a ground plane. The film can be gold, silver or copper or it can be a ceramic material that becomes superconductive at cryogenic temperatures.

22 Claims, 9 Drawing Sheets

PLANAR DUAL MODE FILTERS AND A METHOD OF CONSTRUCTION THEREOF

BACKGROUND OF THE INVENTION

1. Field of the Invention

This invention relates to planar dual-mode filters and to a method of construction of said filters and more particularly to dual-mode planar lumped element or distributive element filters having a thin film on a substrate. The film can be a metallic material such as gold, silver or copper or it can be a ceramic material that becomes superconductive at cryogenic temperatures.

2. Description of the Prior Art

The use of two degenerate modes in microstrip rings and patches to realize dual-mode resonators is known (see a book entitled "Planar Circuits for Microwaves and Light Waves" by T. Okoshi, published in 1985 by Springer-Verlag, pages 36 to 39). See also an article by Wolf entitled "Microstrip Bandpass Filters Using Degenerate Modes of a Microstrip Ring Resonator", Electron LETT, 1972, pages 163 and 164 and further a book entitled "Handbook of Microstrip Antennas" by James, et al., published by Peter Peregrinus Ltd. in 1989, pages 221, 222 and 273. Dual-mode filters made from ring resonators are described in Griffin, et al., U.S. Pat. No. 4,488,131 entitled "MIC Dual-Mode Ring Resonator Filter" and in an article by Guglielmi entitled "Microstrip Ring Resonator Dual-Mode Filters" distributed at a workshop on microwave filters for space applications by European Space Agency/ESTEC in June of 1991. This prior patent and articles describe dual-mode microstrip resonator filters having a structural discontinuity at a 45° angle to the two orthogonal modes.

Fiedziuszko, et al., U.S. Pat. No. 5,136,268 describes a dual-mode planar filter having two or more resonators with a coupling path between resonators being straight or curved, a width of the coupling path being constant over its entire length. The resonators are square resonators with one corner cut-away at a 45° angle to introduce a structural discontinuity. The Fiedziuszko, et al., U.S. Pat. No. 5,172,084 describes a planar dual-mode filter having circular resonators.

A major concern with known patch resonator filters is the difficulty in eliminating undesired coupling between patch resonators that are not interconnected by a coupling path. When this undesirable coupling occurs, the filters cannot be made to realize symmetrical frequency characteristics. Further, known patch resonator filters permit the realization of a relatively narrow bandwidth; or, they have a relatively high loss performance; or, they require the use of tuning elements to achieve the desired coupling.

SUMMARY OF THE INVENTION

It is an object of the present invention to provide a planar dual-mode filter that can be used for conventional room temperature applications or can be constructed of high temperature superconductive films for cryogenic applications. It is a further object of the present invention to provide a planar dual-mode filter that utilizes at least one resonator having two corresponding substantially L-shaped sections that can be made to realize an elliptic function response.

A planar dual-mode filter has a thin film on a substrate, the substrate having a metallization layer on a side opposite to said film. The filter has an input and an output with at least one resonator. Each resonator has two corresponding substantially L-shaped sections. Each of said sections has a back. The sections are oriented back to back relative to one another and are separated by a gap in one direction and are offset from one another by a distance in another direction. Each of the sections has a first arm and a second arm, said arms extending outward from a vertex. The first arms of said two corresponding sections are parallel to one another. The second arms of said two corresponding sections are parallel to one another. The first arms extend in opposite directions to one another and the second arms extend in opposite directions to one another.

A method of constructing a dual-mode planar filter has a film mounted on a substrate, the substrate having a metallic ground plane on a side opposite to said film, said filter having an input and an output, a first resonator having two substantially L-shaped sections, said sections each having a back and being oriented back to back relative to one another, said sections being separated by a gap and being offset from one another by a distance, said method comprising adjusting the size of the gap and adjusting the size of the offset distance to control coupling between the two modes.

Figure 1:
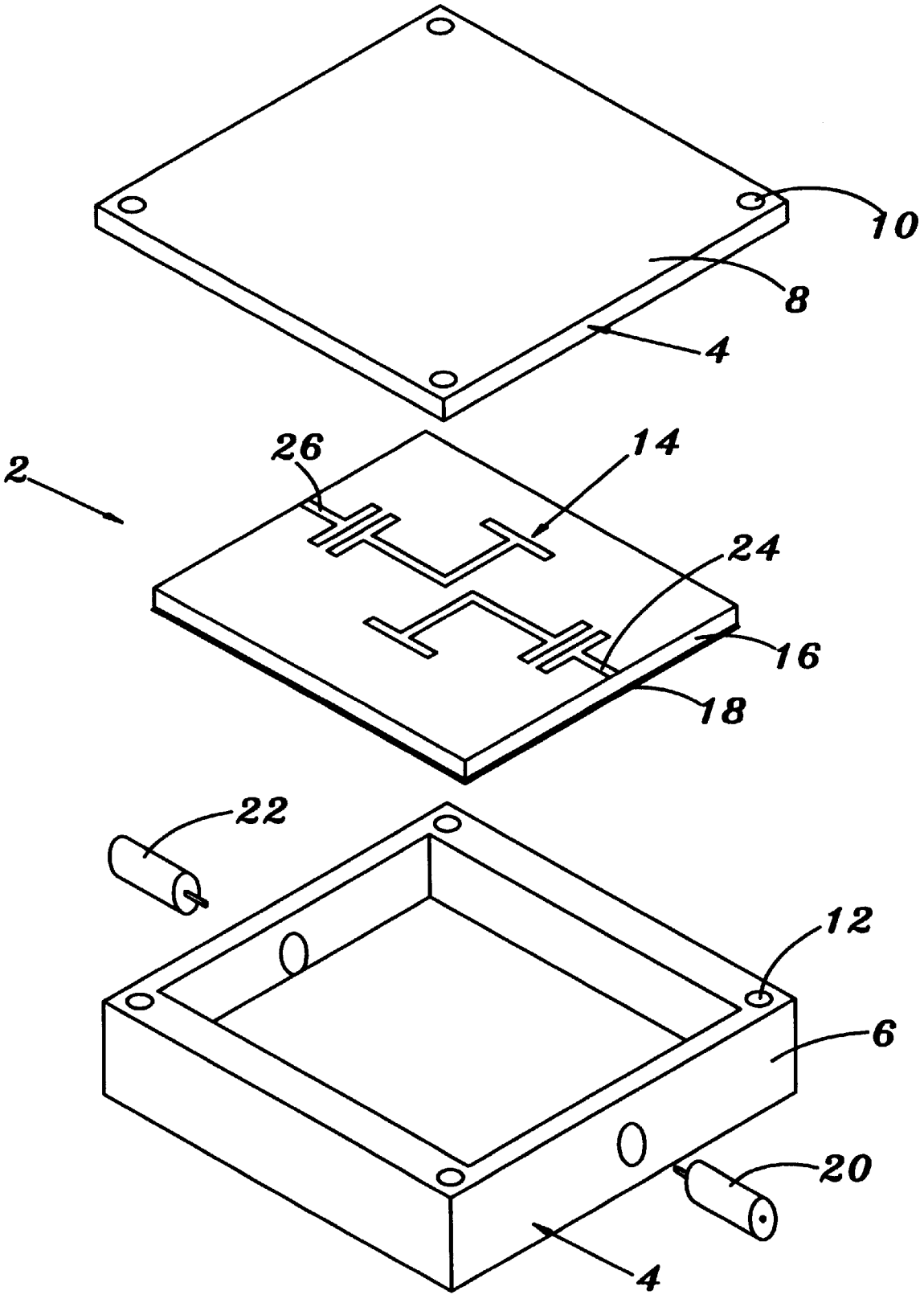
FIG. 1 is an exploded perspective view of a two-pole planar filter in a housing.

Referring to the drawings in greater detail, in FIG. 1, there is shown an exploded perspective view of a two-pole filter 2 having a housing 4 with a base 6 and cover 8. The cover has suitable openings 10 therein which align with openings 12 on the base 6 when the cover is in place on the base. Screws (not shown) extend through the openings 10, 12 to hold the cover in position on the base. A circuit 14 is enclosed in said housing. The housing can be made of any metallic material. The circuit 14 is a film of suitable material on a substrate 16. A ground plane 18 covers a side of the substrate opposite to the circuit 14. The ground plane 18 is a metallization layer made of any known metal. Preferably, the substrate including the ground plane is affixed to the base 6 of the housing 4 by epoxy, soldering or other means. The circuit has an input connector 20 and an output connector 22 for coupling RF energy into and out of the filter respectively. The input connector 20 is connected to an input line 24 and the output connector 22 is connected to an output line 26 of the circuit 14. The circuit 14 is described in greater detail in FIG. 2.

Figure 2:
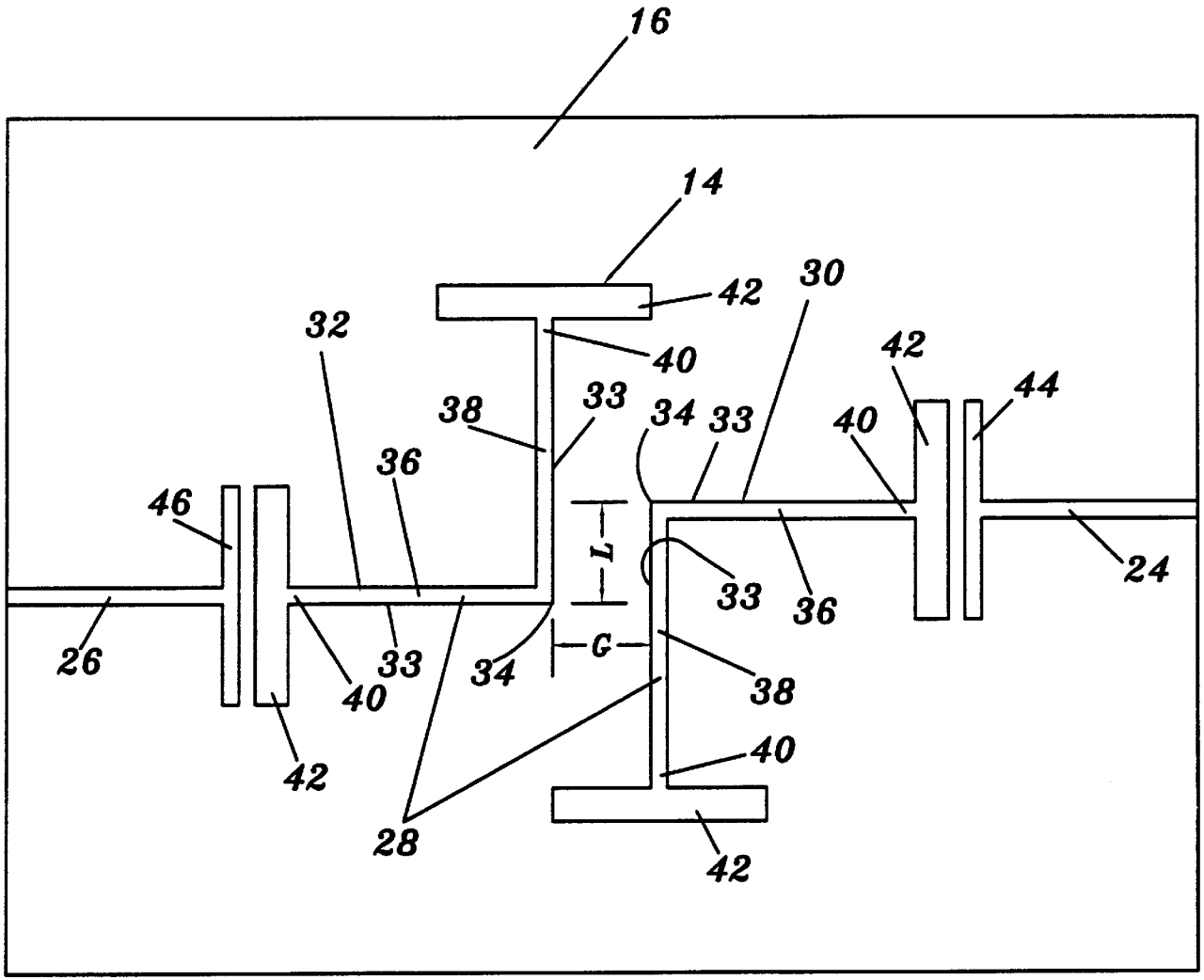
FIG. 2 is a top view of a circuit of said filter on a substrate.

FIG. 2 is a top view of the circuit 14 on the substrate 16. The circuit 14 has an input line 24 and an output line 26 with a dual-mode resonator 28 located between said input and output. The resonator 28 has two sections 30, 32 that each have a back 33. The sections 30, 32 are oriented back to back relative to one another. Each section 30, 32 has a vertex 34 with a first arm 36 and a second arm 38 extending outwardly from said vertex. The sections 30, 32 are spaced apart from one another by an adjustable gap G in one direction and offset from one another by a distance L in another direction. The offset distance L can be positive or negative. When the offset distance L is negative (as shown in FIG. 2), the first arms 36 overlap somewhat with one another. When the offset distance L is positive, the first arm 36 of the section 30 would be moved downward on the sheet of FIG. 2 until it passed an imaginary line extending through the first arm 36 of the section 32. The arms 36, 38 have a free end 40 with a lateral shape located thereon, the lateral shape forming a key-shaped end portion 42 with the free end 40. The input 24 and output 26 have similar T-shaped end portions 44, 46. It can be seen that the end portion 44 of the input 24 is parallel to but spaced apart from the end portion 42 of the first arm 36 of the section 30. Similarly, the end portion 46 of the output line 26 is parallel to but spaced apart from the end portion 42 of the first arm 36 of the section 32. Coupling between the two modes can be controlled by adjusting the gap spacing G and the offset distance L. The circuit 14 can be made from any known thin films such as metallic films of gold, silver or copper or of newly developed ceramic materials which become superconductors at cryogenic temperatures.

Figure 3:
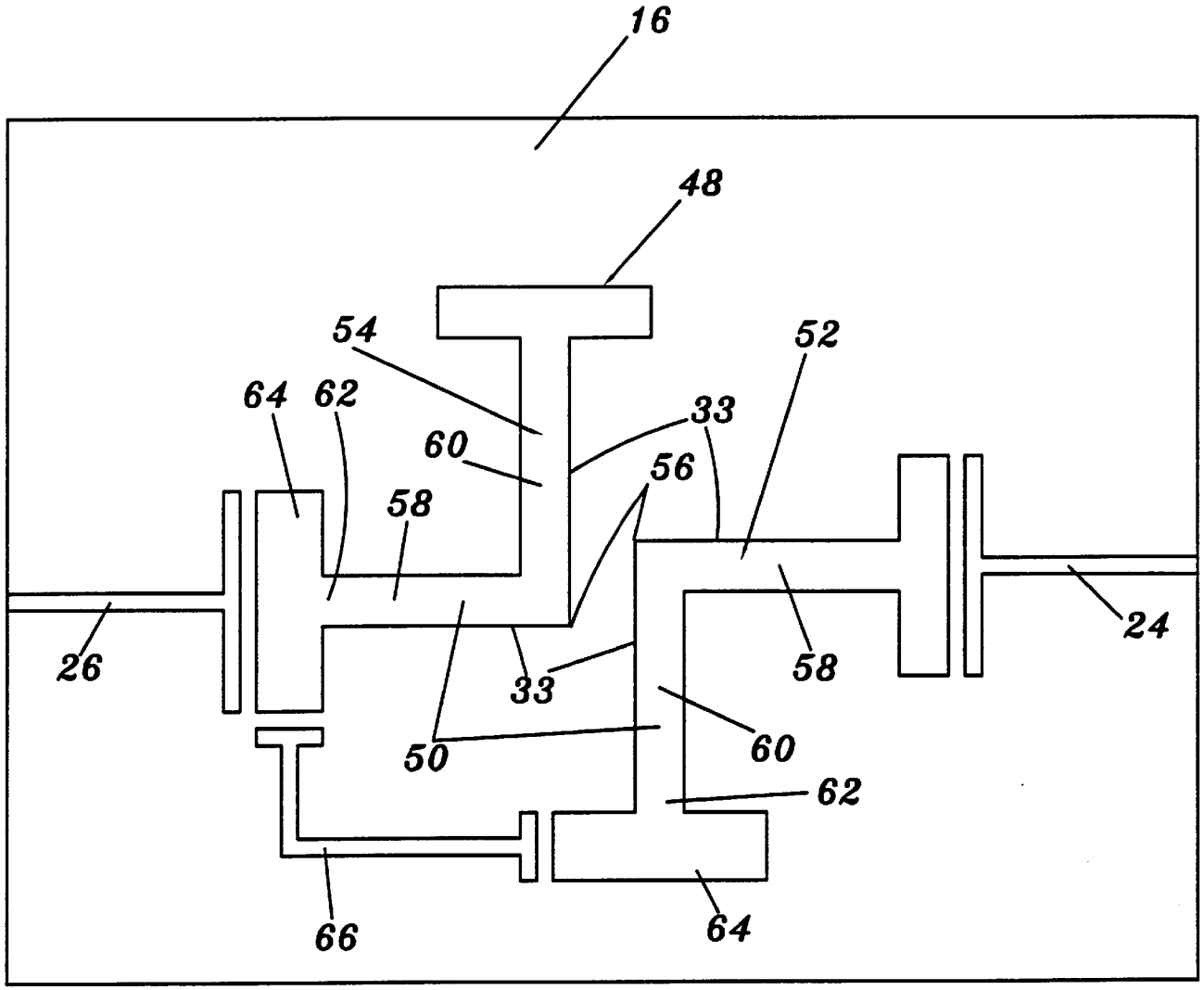
FIG. 3 is a top view of a further embodiment of a circuit of a two-pole filter on a substrate.

In FIG. 3, there is shown a top view of a circuit 48 on a substrate 16. The circuit 48 is nearly identical to the circuit 14 except that the lines of film making up the resonator are wider than said input and output and there is an additional coupling path over that shown for the circuit 14. Those portions of the circuit 48 that are identical to the circuit 14 have been described using the same reference numerals. Those components that are identical to those of the circuit 14 will not be further described. The circuit 48 has a dual-mode resonator 50 that has two L-shaped sections 52, 54. Each section has a vertex 56 with a first arm 58 and a second arm 60 extending outwardly therefrom. Each of the arms 58, 60 has a free end 62 and a lateral member that forms a T-shaped end portion 64 with the free end 62. It can be seen that the sections 52, 54 are separated from one another in one direction and offset from one another in another direction similar to the gap G and distance L (not shown in FIG. 3) of FIG. 2. The additional thickness of the resonators 50 provides additional power handling capability over the circuit 14. A coupling path 66 extends between the T-shaped end portion 64 of the first arm 58 of the section 54 and the T-shaped end portion 64 of the second arm 60 of the section 52 to provide another means for controlling the coupling between the two modes.

Figure 4:
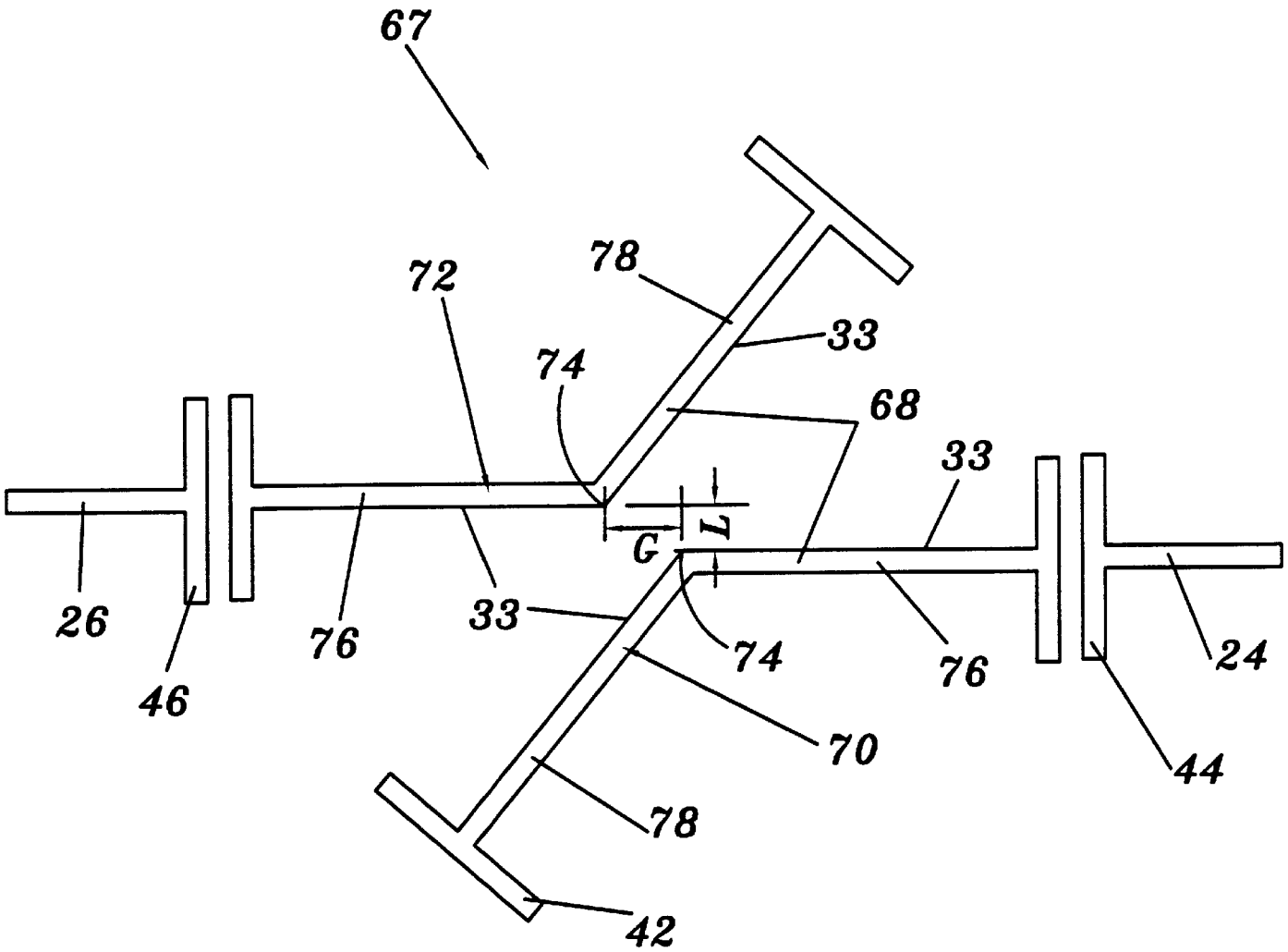
FIG. 4 is a schematic top view of a circuit for a two-pole planar filter where sections of a resonator have angles of approximately 130°.

In FIG. 4, there is shown a schematic top view of a circuit 67 for a two-pole filter. The input 24 and output 26 and T-shaped end portions 44, 46 are identical to those shown for the circuit 14 of FIG. 2. Those components that are identical to components of the previous drawings have been described using the same reference numerals as those used for the previous drawings. A dual-mode resonator 68 has two sections 70, 72. Each section 70, 72 has a vertex 74 with a first arm 76 and a second arm 78 extending outwardly therefrom. T-shaped end portions 42 are identical to those of the circuit 14. It can be seen that the first arms 76 are parallel to one another and the second arms 78 of the sections 70, 72 are parallel to one another. It can also be seen that the arms 76, 78 of each section 70, 72 are at an angle of approximately 130° relative to one another. Any reasonable angle will be suitable and the invention is not restricted in any way to the angle shown. The resonators 70, 72 are separated by a gap G and offset from one another by a distance L. It can be seen that the offset distance L is a positive distance rather than an overlap (i.e. negative) distance as shown in FIGS. 2 and 3.

Figure 5:
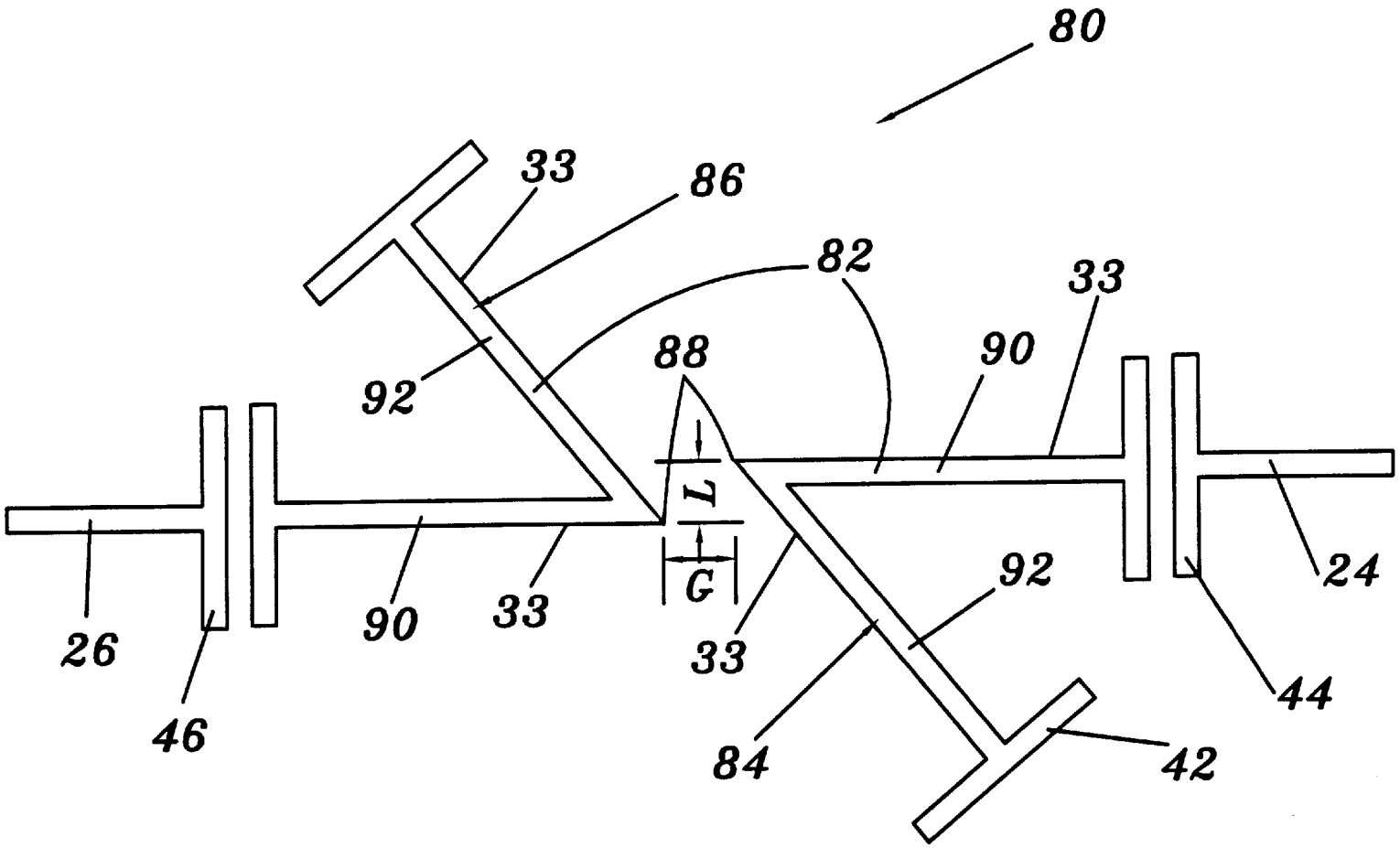
FIG. 5 is a schematic top view of a circuit for a two-pole planar filter where sections of a resonator have angles of approximately 50°.

In FIG. 5, there is shown a schematic top view of a circuit 80, which is similar to the circuit 67 of FIG. 4 except that the arms of the dual-mode resonator are at an angle of less than 90° whereas the arms of the circuit 67 are at an angle of greater than 90°. The input 24, output 26, backs 33, T-shaped end portions 44, 46 and 42 are identical to those shown for the circuit 14 of FIG. 1 and have been described using the same reference numerals as those used for FIG. 1. A dual-mode resonator 82 has sections 84, 86. Each section has a vertex 88 with a first arm 90 and a second arm 92 extending outwardly therefrom. The arms 90, 92 of each section 84, 86 have an angle of approximately 50°. Any reasonable angle will be suitable and the invention is not restricted in any way to the angle specified. Preferably, the angle of the two sections will lie within a range of substantially 40° to substantially 140°. In FIGS. 4 and 5, the substrate and housing have been omitted.

In FIGS. 4 and 5, it is considered that the sections 70, 72, 84, 86 are substantially L-shaped even though the angle ranges from approximately 50° for the circuit 80 to approximately 130° for the circuit 67. An advantage of using substantially L-shaped sections for the dual-mode resonators of varying angles is that the size and location of the various components can be varied depending on the space available and the application in which the filters are being used. This is particularly advantageous when a large number of resonators are required.

DESCRIPTION OF A PREFERRED EMBODIMENT

Figure 6:
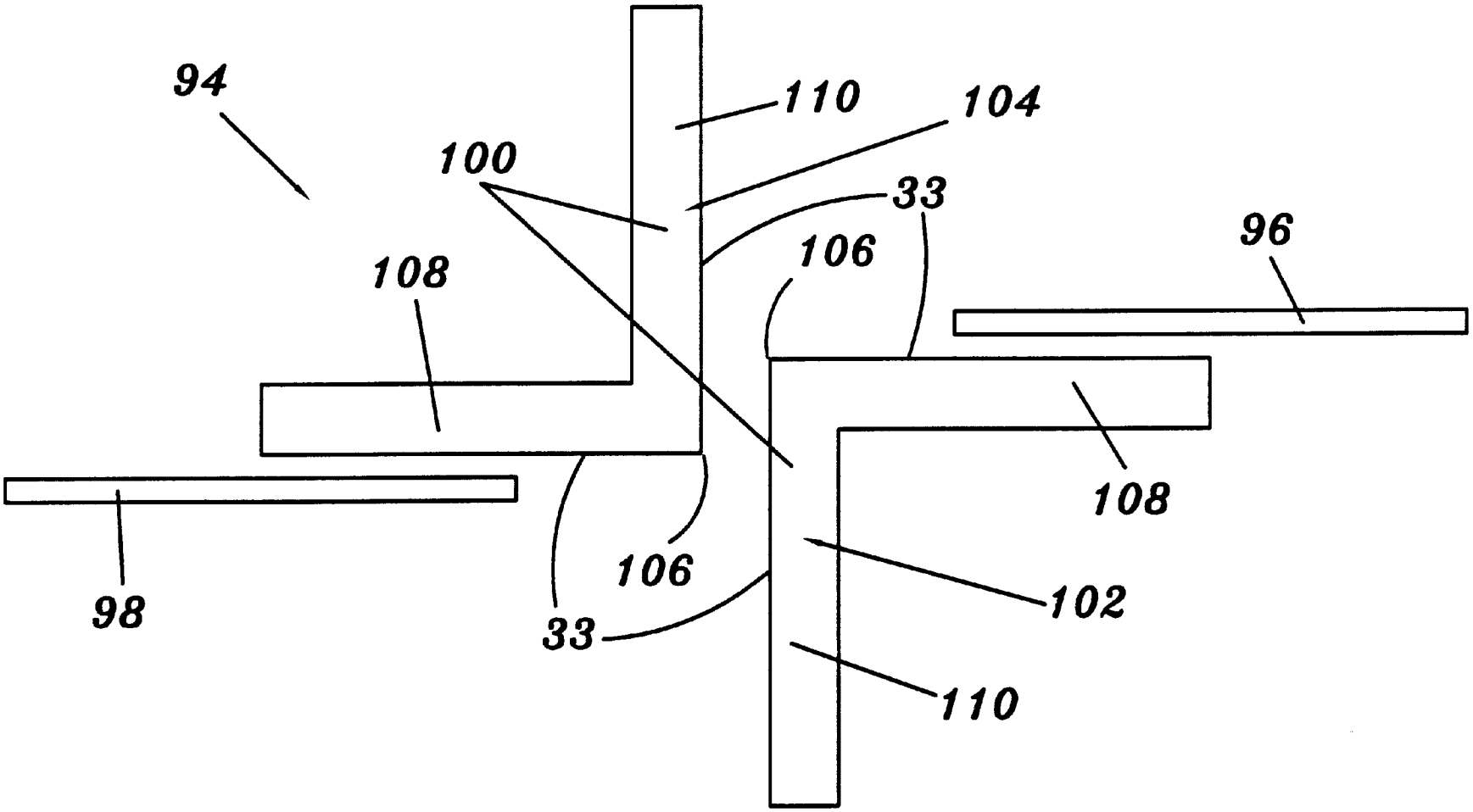
FIG. 6 is a schematic top view of a two-pole planar filter having a resonator the sections having an angle of approximately 90° with parallel input and output coupling.

The resonators shown in FIGS. 1 to 5 are constructed using lumped elements. These resonators can also be constructed using distributed elements as shown in FIG. 6. In FIG. 6, there is shown a schematic top view of a circuit 94. The substrate and housing have been omitted. The circuit 94 has an input line 96 and an output line 98. The input/output lines 96, 98 use parallel coupling. A dual-mode resonator 100 has two sections 102, 104. Each section has a vertex 106 with a first arm 108 and a second arm 110 extending outwardly therefrom. Each section has a back 33. As stated, the resonator 100 is constructed using distributed elements rather than lumped elements. Further, the line width of the resonator 100 is greater than that shown for the resonator in the circuit 14. Resonators of the type shown in FIG. 6 are particularly suitable where high power dual-mode planar filters are required and the line width can be chosen as thick or thin, as desired.

Figure 7:
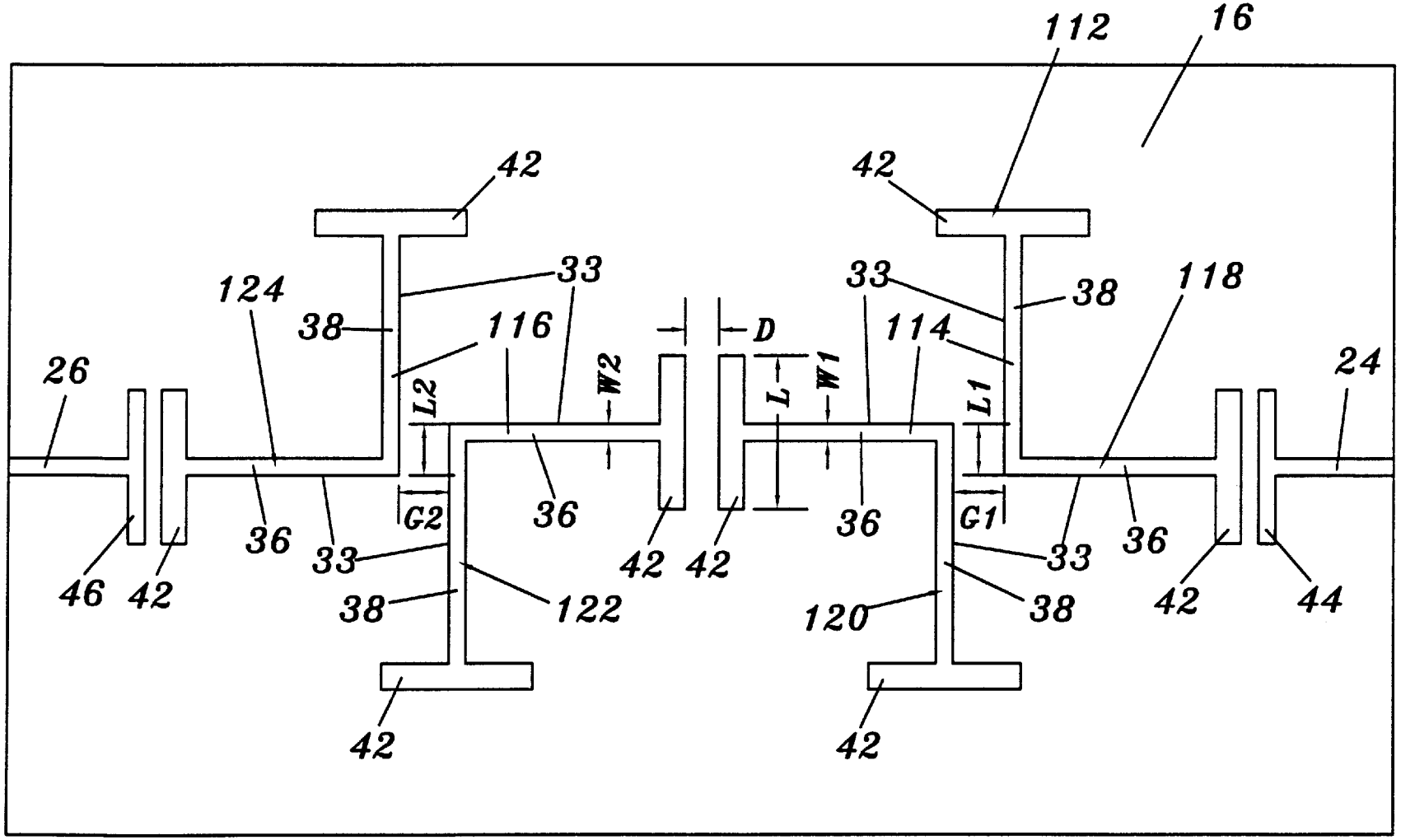
FIG. 7 is a schematic top view of a circuit for a four-pole planar filter on a substrate.

In FIG. 7, there is shown a top view of a circuit 112 on a substrate 16. The circuit 112 has two dual-mode resonators 114, 116. Since the two sections making up each of the resonators 114, 116 is virtually identical to the resonator 28 shown in FIG. 2, the same reference numerals have been used for the first arm 36 and the second arm 38 of the resonators 114, 116, T-shaped end portions 42 and the input 24 and output 26 with T-shaped end portions 44, 46 respectively. The resonator 114 has two sections 118, 120 and the resonator 116 has two sections 122, 124. The gap size $G_1$ and offset distance $L_1$ can be different for the resonator 114 than the gap size $G_2$ and the offset distance $L_2$ of the resonator 116. Similarly, the line width $W_1$ for the resonator 114 can be different than the line width $W_2$ for the resonator 116.

The circuit 112 is a layout of a four-pole Chebyshev filter realized using lumped element resonators. In operation, resonator 114 carries modes 1, 2 while resonator 116 carries modes 3, 4. Coupling between modes 1, 2 is controlled by adjusting $L_1$ and $G_1$ while coupling between modes 3 and 4 is controlled by adjusting $L_2$ and $G_2$. Coupling between modes 2 and 3 is controlled by adjusting a gap spacing D and a length L of the T-shaped end portions 42 of the section 120 of the resonator 114 and 122 of the resonator 116.

Figure 8:
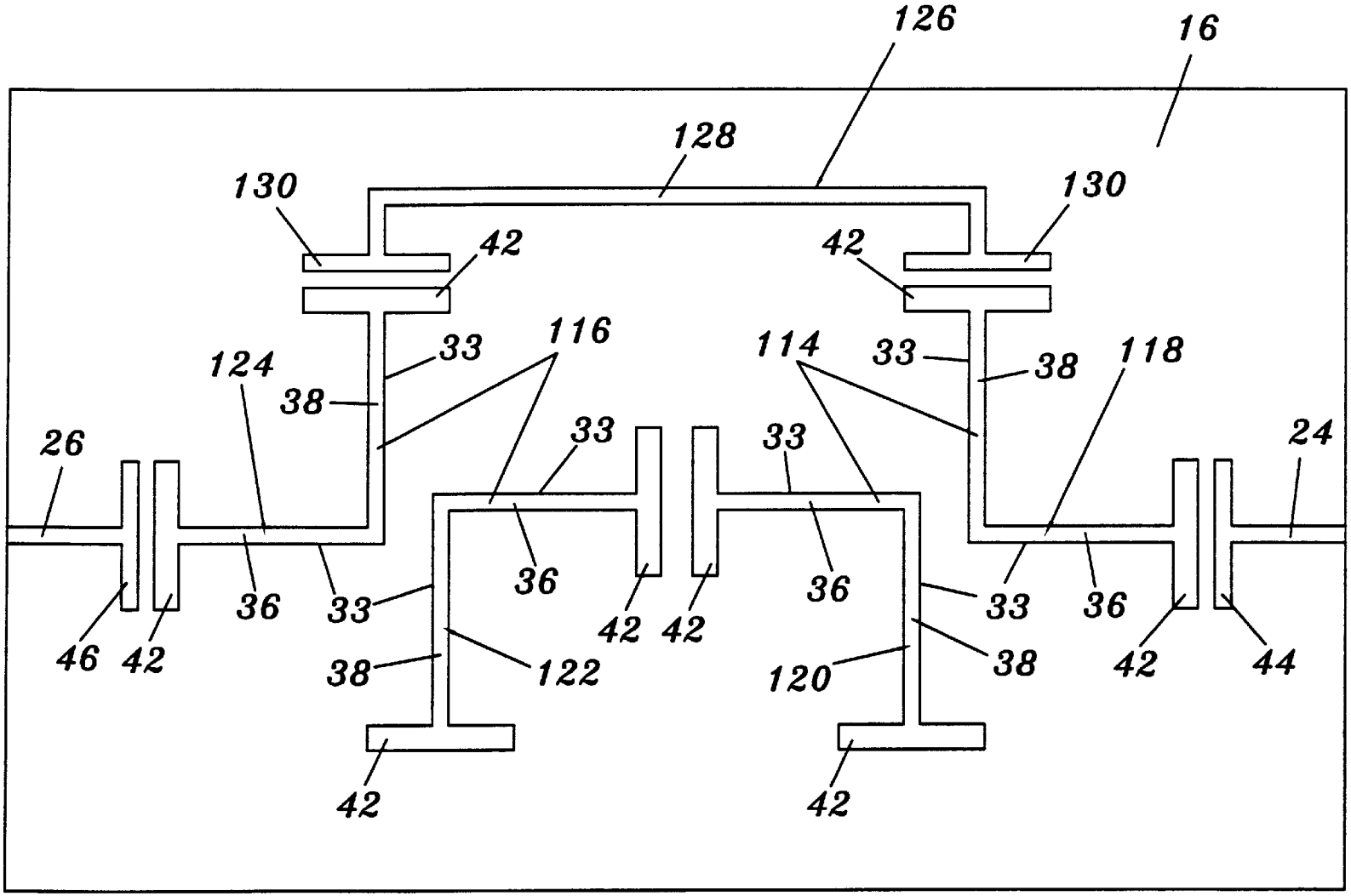
FIG. 8 is a schematic top view of a circuit for a further embodiment of a four-pole planar filter on a substrate.

In FIG. 8, there is shown a schematic top view of a circuit 126 on a substrate 16. The circuit 126 is virtually identical to the circuit 112 of FIG. 7 except that the circuit 126 has an additional coupling path 128. The remaining components of FIG. 8 are described using the same reference numerals as those used for FIG. 7. The coupling path 128, with T-shaped end portions 130 extends between the T-shaped end portions 42 of the second arm 38 of the section 118 of the resonator 114 and the T-shaped end portion 42 of the second arm 38 of the section 124 of the resonator 116.

The coupling path 128 provides the necessary coupling between modes 1 and 4 which in turn is required to realize an elliptic function response.

Figure 9:
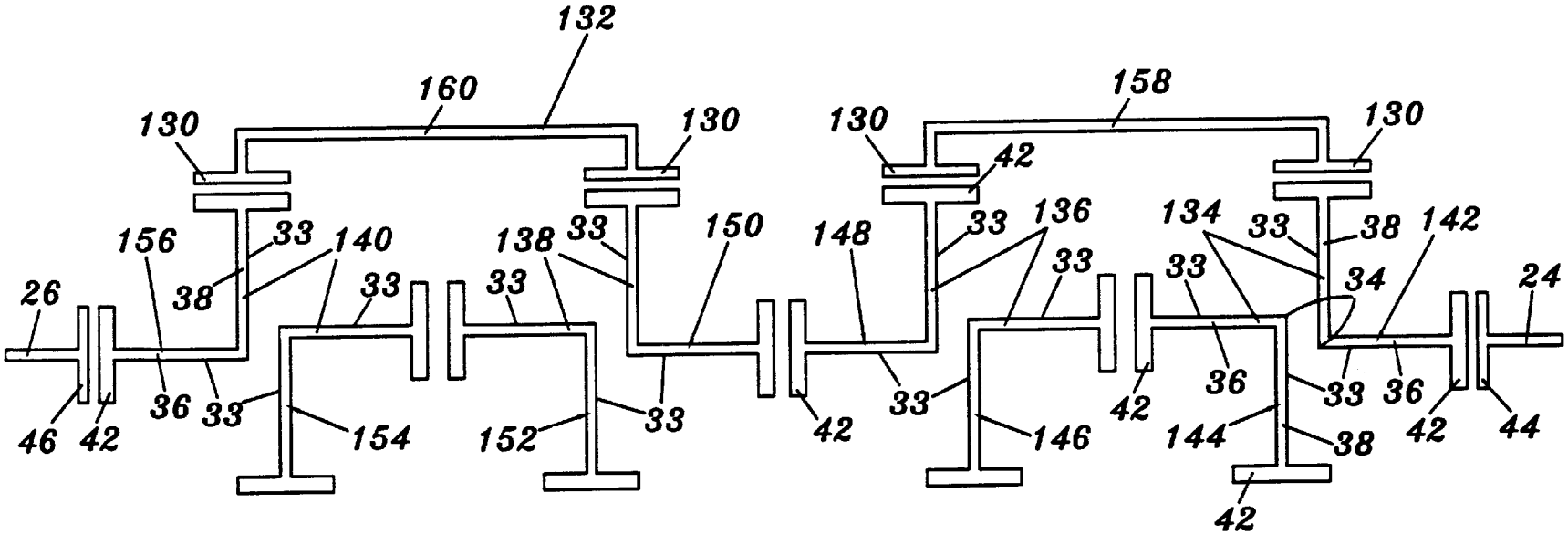
FIG. 9 is a schematic top view of a circuit for an eight-pole filter.

In FIG. 9, there is shown a schematic top view of a circuit 132 for a filter having four dual-mode L-shaped resonators 134, 136, 138, 140. The resonator 134 has two sections 142, 144 and the resonator 136 has two sections 146, 148. The resonator 138 has two sections 150, 152 and the resonator 140 has two sections 154, 156. There is an additional coupling path 158 extending between the section 142 of the resonator 134 and the section 148 of the resonator 136. Similarly, there is an additional coupling path 160 extending between the section 150 of resonator 138 and section 154 of the resonator 140. The additional coupling paths 158, 160 are all U-shaped and have T-shaped end portions 130 thereon. The remaining components of the circuit 132 are similar to those described for the circuit 14 of FIG. 2 and the same reference numerals are therefore used. For example, each section of the resonators 134, 136, 138, 140 has a vertex 34, a first arm 36 and a second arm 38. It can be said that the first and second resonators are oriented to form a general mirror image with one another and the third and fourth resonators are oriented to form a general mirror image with one another. The mirror image is said to be general rather than exact because the gaps, offset distances and line widths may be different for each of the resonators. To keep FIG. 9 as simple as possible, reference numerals of those components that are similar to other components of FIG. 9 have sometimes been omitted.

In operation of a filter constructed in accordance with the circuit 132, coupling between the first and fourth modes is realized using coupling path 158 while coupling between the fifth and eighth modes is realized using coupling path 160. Circuit 132 shows that a dual-mode lumped element resonator filter can be constructed with a compact size to produce a high order elliptic function filter.

While the present invention has been fully described in connection with a preferred embodiment thereof, it should be noted that various changes and modifications will be apparent to those skilled in the art. By way of example, the techniques described above are not restricted to microstrip structures and can be applied as well to other planar structures, for example, co-planar lines, striplines and suspended microstriplines. The description of the present invention should be construed to include these other structures except where common sense otherwise indicates due to the specific wording used.

We claim:

1. A planar dual mode filter comprising:

(a) a thin film on a substrate, said substrate having a metallization layer on a side opposite to said film;

(b) an input and an output;

(c) at least one dual mode resonator formed from said thin film, each resonator having two corresponding substantially L-shaped sections, each of said sections having a back, said sections being oriented back to back relative to one another, said sections being separated by a gap in one direction and being offset from one another by a distance in another direction;

(d) each of said sections having a first arm and a second arm, said arms extending outward from a vertex, the first arms of said two corresponding sections being parallel to one another, the second arms of said two corresponding sections being parallel to one another, said first arms extending in opposite directions to one another, said second arms extending in opposite directions to one another.

2. A filter as claimed in claim 1 wherein each arm has a free end at an end opposite to said vertex and each free end has a substantially T-shaped end portion formed with said free end.

3. A filter as claimed in claim 2 wherein the thin film is selected from the group consisting of a metallic material and high temperature superconductive material that becomes conductive at cryogenic temperatures.

4. A filter as claimed in claim 3 wherein the input and the output have a T-shaped end portion thereon corresponding to the end portions of said arms, the end portions of said input and output being spaced apart from the end portions of said arms.

5. A filter as claimed in claim 1 wherein the distance that the sections are offset from one another is the offset distance, the offset distance ranging from a positive distance to a negative distance.

6. A filter as claimed in claim 4 wherein there is a coupling path extending between, but spaced apart from, a free end of said first arm of one section and a free end of said second arm of another section.

7. A filter as claimed in claim 6 wherein said coupling path has substantially T-shaped end portions.

8. A filter as claimed in claim 1 wherein said at least one resonator is a first resonator and there is a second resonator located between said input and said output, said second resonator having two L-shaped sections and being similar to said first resonator.

9. A filter as claimed in claim 8 wherein there is a coupling path extending between, but spaced apart from, the free end of the second arm of one section from said first resonator and the free end of the second arm of one section from said second resonator.

10. A filter as claimed in claim 8 wherein there are four resonators, said first resonator, said second resonator, a third resonator and a fourth resonator, said four resonators having a shape that is similar to one another, said first and second resonators being oriented to form a general mirror image with one another, said third and fourth resonators being oriented to form a general mirror image with one another.

11. A filter as claimed in claim 10 wherein there is a U-shaped coupling path extending between the free end of the second arm of one section of the first resonator and the free end of the second arm of one section of the second resonator and a U-shaped coupling path extending between the free end of the second arm of one section of the third resonator and the free end of the second arm of one section of the fourth resonator respectively.

12. A filter as claimed in claim 11 wherein the input and output, the free ends of all of the arms of the resonators and the free ends of the U-shaped coupling path all have T-shaped end portions thereon.

13. A filter as claimed in any one of claims 1, 3 or 4 wherein said at least one resonator has arms that are substantially wider than said input and output.

14. A filter as claimed in claim 4 wherein the arms and T-shaped end portions of said at least one resonator are substantially wider than said T-shaped end portions of said input and output, there being a coupling line having T-shaped end portions extending between one of said T-shaped end portions of one section and one of said T-shaped end portions of another section.

15. A filter as claimed in any one of claims 1, 2 or 4 wherein an angle between the arms of each section at said vertex is substantially 90°.

16. A filter as claimed in any one of claims 1, 2 or 3 wherein an angle of the arms of each section at said vertex is in a range from substantially 40° to substantially 140°.

17. A filter as claimed in claim 1 wherein part of said input is located alongside of said first arm of one of said sections in a parallel coupling arrangement and part of said output is located adjacent to said first arm of another of said sections in a parallel coupling arrangement.

18. A filter as claimed in claim 8 wherein said input and output as well as a free end of each arm of said first and second resonators has a T-shaped end portion thereon, said first and second resonators being spaced slightly apart from one another and being non-identical to one another, said first and second resonators being oriented as a general mirror image to one another.

19. A filter as claimed in claim 18 wherein there is a coupling path extending between, but spaced apart from, the free end of the second arm of one section from said first resonator and the free end of the second arm of one second resonator, said coupling path having T-shaped end portions thereon that correspond to T-shaped end portions on the second arms of said first and second resonator.

20. A method of constructing a dual mode planar filter having a film mounted on a substrate, said substrate having a metallic ground plane on a side opposite to said film, said filter having an input and an output and resonating at its resonant frequency in two modes simultaneously, a first resonator having two substantially L-shaped sections, said sections each having a back and being oriented back to back relative to one another, said sections being separated by a gap and being offset from one another by a distance, said method comprising adjusting the size of the gap and adjusting the size of the offset distance to control coupling between said two modes.

21. A method as claimed in claim 20 including the step of adjusting a line width to control coupling between the two modes.

22. A method as claimed in any one of claims 20 or 21 wherein there is more than one resonator and all of said resonators have a similar shape, said method including the step of controlling the coupling between adjacent resonators by adjusting a distance between said adjacent resonators.

* * * * *